US006471190B2

(12) United States Patent
Lindeman

(10) Patent No.: US 6,471,190 B2
(45) **Date of Patent: *Oct. 29, 2002**

(54) REEL ASSEMBLY

(75) Inventor: Gunnar Andreas Lindeman, Haslum (NO)

(73) Assignee: Schlumberger Technology Corporation, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/529,829

(22) PCT Filed: Oct. 23, 1998

(86) PCT No.: PCT/IB98/01703

§ 371 (c)(1),
(2), (4) Date: Apr. 30, 2000

(87) PCT Pub. No.: WO99/21790

PCT Pub. Date: May 6, 1999

(65) Prior Publication Data

US 2002/0056777 A1 May 16, 2002

(30) Foreign Application Priority Data

Oct. 28, 1997 (GB) ..... 9722759

(51) Int. Cl.[7] ..... B66D 1/30; B65H 51/02
(52) U.S. Cl. ..... 254/371; 254/374; 242/366
(58) Field of Search ..... 242/366.3, 366–365; 254/374, 371

(56) References Cited

U.S. PATENT DOCUMENTS

| | | | | | |
|---|---|---|---|---|---|
| 625,874 | A | * | 5/1899 | Crossley | 254/371 |
| 2,654,139 | A | * | 10/1953 | Lorig | |
| 3,635,441 | A | * | 1/1972 | Haines | 254/371 |
| 4,054,265 | A | * | 10/1977 | Magg et al. | 254/371 |
| 4,657,202 | A | * | 4/1987 | Sauber | 254/374 |
| 4,676,483 | A | * | 6/1987 | Magill | 242/366 |
| 4,688,765 | A | * | 8/1987 | Guangorena | 254/374 |
| 4,899,988 | A | * | 2/1990 | Mills | 254/374 |
| 5,186,283 | A | * | 2/1993 | Salmon | 254/333 |

* cited by examiner

*Primary Examiner*—Emmanuel Marcelo
(74) *Attorney, Agent, or Firm*—Streets & Steele; Jeffrey L. Streets

(57) ABSTRACT

A capstan winch includes a reel assembly comprising a reel, which rotates, and two generally annular floating flanges which are supported so that the planes in which they rotate converge toward one another, which has the effect of creating an apparent axial movement of the flanges with respect to the reel as they rotate together. The cylindrical surface of the reel is provided with alternating lands and grooves and floating flanges have formed on them alternating inclined faces which correspond with the lands and the grooves. The inclined faces are angled so that the faces which correspond to each land on the reel are generally parallel to one another. The inclined faces which correspond to each groove converge. Consequently, substantial lateral forces are exerted on a cable being wound onto the reel only when the cable overlies the grooves and frictional forces on the cable are minimized.

9 Claims, 3 Drawing Sheets

REEL ASSEMBLY

BACKGROUND OF THE INVENTION

The present invention relates to a reel assembly, in particular, a reel assembly for use in a capstan winch of the kind used to deploy and wind in cables used in underwater and seabed applications, for example, seismic cables.

Such capstan winches are used to de-tension seismic cables which, typically, make several turns around the capstan winch before passing to a storage winch. The capstan and storage winches are driven so as to maintain constant tension in the length of cable between the two winches.

The capstan winch also acts to align the cable with the storage winch downstream by, for example, centering the cable as it passes around the reel of the capstan winch. This involves exerting lateral forces on the cable while it is under tension, leading to twisting or, worse, damage to the cable. It is an object of the present invention to alleviate this problem.

SUMMARY OF THE INVENTION

In accordance with the invention, there is provided a reel assembly and a capstan winch incorporating a reel assembly, the reel assembly comprising a reel mounted for rotation and having a generally cylindrical surface onto which a cable can be wound and a pair of generally annular floating flange elements mounted for rotation with the reel, the flange elements being supported so that the planes in which they rotate converge towards one another; the generally cylindrical surface of the reel being provided with a plurality of alternating lands and grooves extending from one flange element to the other and the flange elements each having formed on a generally annular surface thereof which, in a respective direction of rotation, contacts a cable being wound onto the reel, a plurality of alternating inclined faces which correspond with the alternating lands and grooves on the generally cylindrical surface of the reel; the alternating inclined faces being so angled that the inclined faces formed on the two flange elements which correspond to each land formed on the reel are generally parallel to one another and the inclined faces formed on the two flange elements which correspond to each groove formed on the reel converge towards one another, so that substantial lateral forces are exerted on a cable being wound onto the reel only when the cable overlies the grooves formed on the reel.

Because the floating flange elements exert a lateral force on the cable substantially only when it is overlying the grooves formed in the reel, friction between the cable and the reel is reduced, allowing the cable to slide sideways more easily. Thus the risk of damage to the cable is reduced.

Conveniently, the flange elements converge towards each other symmetrically with respect to a plane perpendicular to the axis of rotation of the reel.

In a preferred embodiment of the invention, said plurality of inclined faces is formed by a plurality of smoothly curved elements detachably secured around the annular face of each flange element, and said plurality of lands and grooves is formed by a plurality of curved sections detachably secured around the cylindrical surface of the reel.

BRIEF DESCRIPTION OF THE DRAWINGS

An embodiment of the invention will now be described in detail, by way of example, with reference to the drawings, in which.

DETAILED DESCRIPTION OF THE PREFERRED EMBODIMENT

Figure 1:
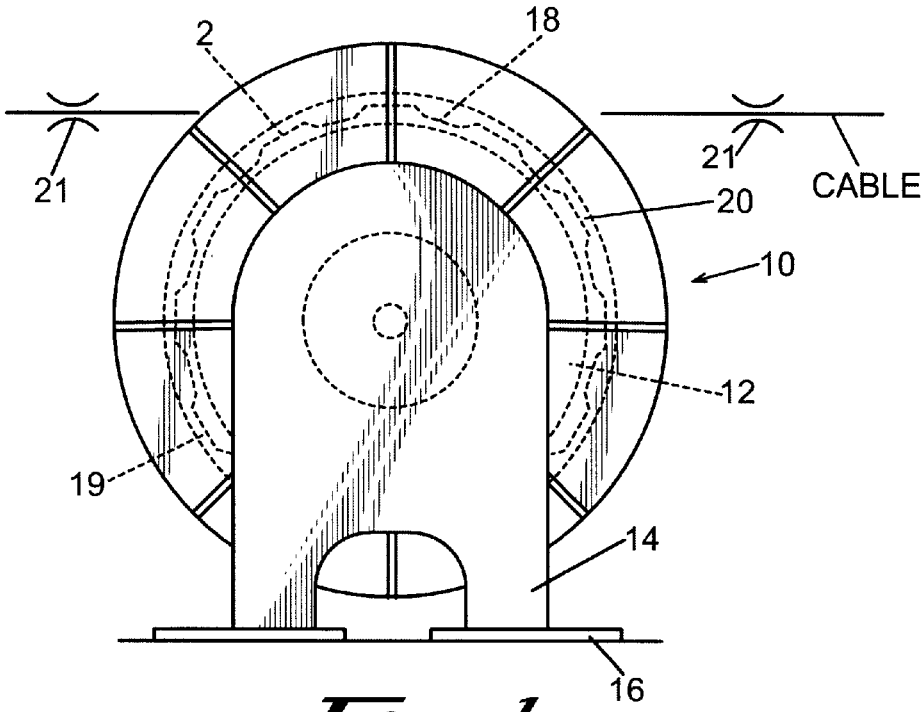
FIG. 1 is side view of a capstan winch incorporates a reel assembly, both in accordance with the present invention.

The capstan winch 10 shown in the drawings is intended for use in deploying, towing and retrieval of lead-in and seismic cables used in underwater and seabed applications. The capstan winch 10 is placed between the stern of the vessel from which the cable is to be deployed and a main storage winch and acts with the storage winch to de-tension the cable. The capstan winch 10 controls the speed at which the cable is reeled in and out while the storage winch operates to maintain a constant tension in the section of cable between the capstan winch 10 and storage winch. Both the capstan winch 10 and main storage winch are driven by and under the control of conventional hydraulic motors and control circuitry (not shown). Typically the cable makes several turns around the capstan winch 10 before being led away to the main storage winch.

As shown in the drawings, the capstan winch 10 consists of a single reel 12 supported by two bearing brackets 14 which are provided with flanges 16 by means of which the brackets 14 can be bolted to the deck of a vessel on which the winch 10 is to be used. The reel 12 is provided with conventional hydraulic motor drive means and hydraulic control circuitry (not shown) so that the reel 12 can be rotated relative to the bearing brackets 14 to wind the cable toward or away from the main storage winch as needed.

The circumferential surface of reel 12 is shaped to form a plurality of regularly spaced grooves or depressions 18 extending generally parallel to the axis of rotation of the reel 12.

Consequently, as the cable is wound onto and around the reel 12, it contacts the surface of the reel 12 only in the raised areas (or lands) 19 between the grooves or depressions 18.

The reel 12 is provided with floating flanges 20 which are mounted so that they can move or "float" relative to the reel 12 but rotate with it, ie they are not directly attached to the periphery of the reel 12, but spaced radially therefrom with a small clearance. As can be seen most clearly in FIG. 2, the floating flanges 20 are not parallel to one another, but rather, as they rotate, they maintain a constant inclination to one another and to the central axial plane of the reel 12 (which is coincident with the section line III—III in FIG. 2). The floating flanges 20 are wide apart at the top of the reel 20 and inclined so that they converge symmetrically towards one another at the diametrically opposite bottom point of the reel 12.

This alignment of the flanges 20 is achieved by mounting each flange 20 to rotate about an axis slightly inclined to that around which the reel 12 rotates. Preferably, the flanges 20 are driven by the rotation of the reel 12 itself, for example, by the engagement of one or more drive pegs projecting from the reel 12 with suitable bearing surfaces formed on the flanges 20. These bearing surfaces will, of course, have to be shaped to accommodate the apparent axial movement between the reel 12 and the flanges 20 which occurs at each point on the circumference of the reel 12 as the reel turns through a complete revolution.

To avoid any damage likely to be caused to the cable if the cable were to be trapped between the reel 12 and the flanges 20, the aforementioned small radial clearance between the flanges 20 and the reel 12 is much less than the thickness of the cable, typically, around 6 mm. This is sufficient, however, to allow the apparent axial movement between the reel 12 and the floating flanges 20.

To guide the seismic cable into and out of the capstan winch 10, two annular inlet/outlet guides 21 are secured to the tops of respective ones of the brackets 14 (the means for securing the guides 21 to the tops of respective ones of the brackets 14 is not shown in FIG. 1 in order to simplify the description of the present invention). These guides are shown very diagrammatically at 21 in FIG. 1, where it can be seen that their axes extend substantially tangentially of the top of the reel 12. The positioning of the guides 21 axially of the reel is such that they are disposed one on each side of and closely adjacent the gap defined by respective vertical planes which are perpendicular to the axis of the reel and which pass through the flanges 20 at their lowermost, closest-together, points.

The effect of the converging floating flanges 20 is that as the reel 12 rotates in either direction, one of the floating flanges 20 contacts the edge of the cable being wound onto the capstan winch 10 and urges it towards the other floating flange 20. This, together with the respective inlet/outlet guides 21, ensures that, as the cable leaves the capstan winch 10, it is straight and properly aligned with any equipment upstream or downstream of the capstan winch 10, for example, a storage winch.

It will be appreciated that, although the description above refers to the convergence of the floating flanges 20 from the 'top' to the 'bottom' of the reel 12, proper alignment of the cable on the reel 12 will be achieved provided that the floating flanges converge, irrespective of the orientation of the direction of convergence relative to the capstan winch 10.

As mentioned above, it is important to ensure that twisting of the cable does not occur as the cable is wound onto the capstan winch 10. To minimise twisting of the cable, the opposite annular faces 22 (see FIG. 2 in conjunction with FIG. 3) of the floating flanges 20 which contact the cable to urge it towards the central portion of the reel 12 are not flat, but are profiled (best shown in FIG. 2) to co-operate with the grooves 18 formed in the cylindrical surface of the reel 12.

Figure 2:
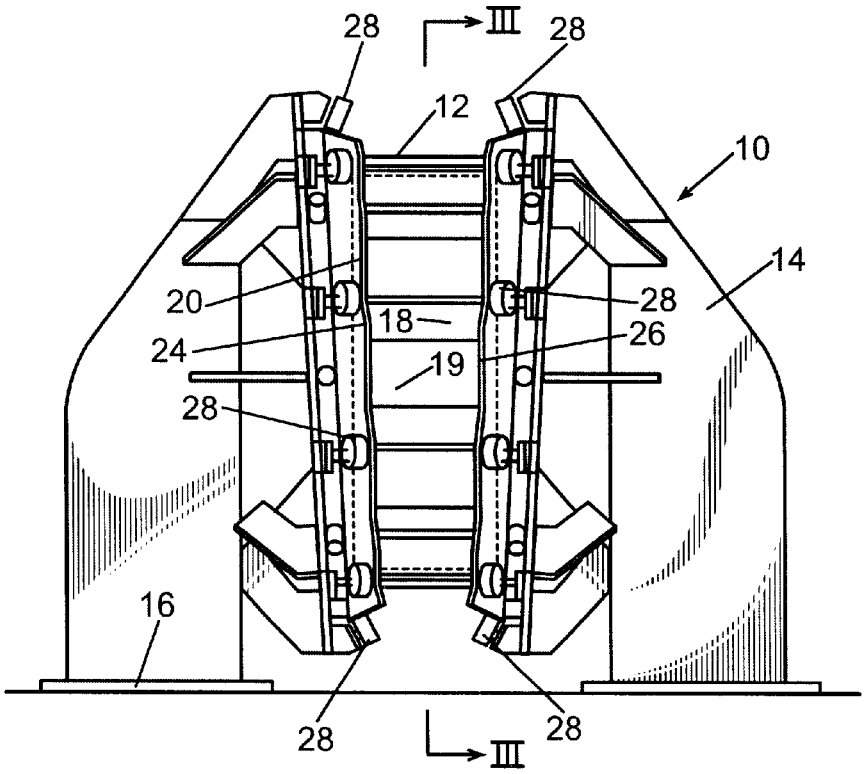
FIG. 2 is front view of the capstan winch of FIG. 1.
Figure 3:
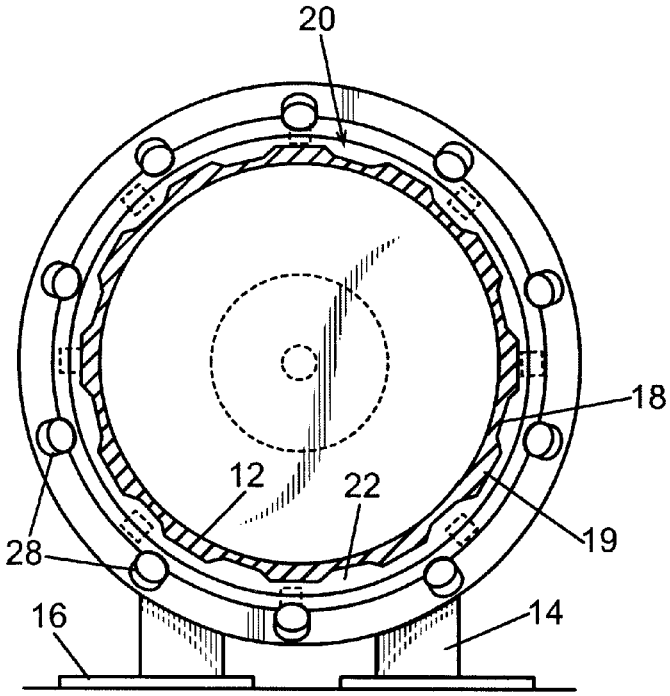
FIG. 3 is a sectional view taken on line III—III of FIG. 2.

As can be seen from FIGS. 2 and 3, the annular surfaces 22 of the floating flanges 20 have alternating angled faces 24 and 26 which correspond, circumferentially, with the grooves 18 formed on the surface of the reel 12 and the lands 19 which separate those grooves.

Thus if the lands 19 and grooves 18 are of equal width, the faces 26 and 24 which correspond to them will be of equal circumferential extent, but if, on the other hand, the grooves 18 are narrower than the lands 19 which separate them, the faces 26 which correspond to the lands 19 will be of greater extent, measured in a circumferential direction, than the faces 24 which correspond to the grooves 18. As mentioned above, the floating flanges 20 are mounted so that they rotate with the reel 12, for example, by means of roller bearings 28 between the floating flanges 20 and opposed faces of the brackets 14. Consequently the faces 24 and 26 on the annular surfaces 22 of the floating flanges 20 remain aligned at all times during rotation of the reel 12 with the corresponding grooves 18 and lands 19.

The angling of the faces 24 and 26 formed on the floating flanges 20 is chosen in dependence on the angle at which the floating flanges 20 converge. The angles at which the faces 24 and 26 are set are chosen so that, as can be seen in FIG. 2, the faces 24 which are associated with the grooves 18 converge towards one another in the same direction as the floating flanges 20 while the faces 26 are substantially parallel to one another.

Consequently, as a cable is wound onto the reel 12, the only sideways force exerted by the floating flanges 20 on the cable to urge it towards the central part of the reel 12 is exerted by the faces 24 which contact the cable only where the cable is overlaying the grooves 18.

Substantially no lateral force is exerted by the faces 26 which are generally parallel to one another and perpendicular to the axis of rotation of the reel 12. As a result, the frictional forces on the cable are minimised.

Figure 4:
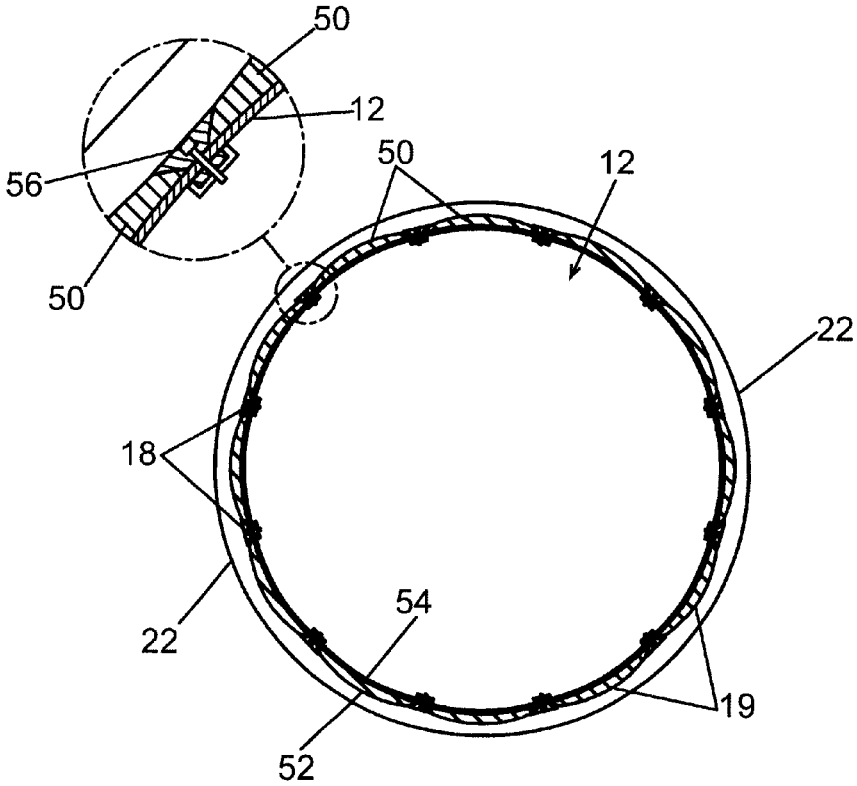
FIG. 4 is a sectional view analogous to that of FIG. 3 showing a preferred arrangement for providing lands and grooves on the reel assembly of the capstan winch of FIGS. 1 to 3.

A preferred reel construction for use in the reel assembly of the invention is shown in FIG. 4.

In this construction the lands and grooves 18 and 19 are formed by securing around the circumference of the reel 12 a plurality of curved sections 50, each of which extends generally axially of the reel 12. The sections 50 are of uniform cross section, each having an external surface 52 with a smaller radius of curvature than the internal surface 54, which fits snugly against the surface of the reel 12. The sections 50 are secured by means of suitable fasteners 56 which are disposed in the grooves 18 formed between adjacent sections 50 where they will not come into contact with the cables, thus avoiding any risk of damage to the cables by the fasteners 56.

As can be seen from FIG. 4, the lands 19 are formed by the central protruding parts of the curved sections 50 which, because of the smaller radius of curvature of the external surface 52, project further in a radial direction than do the edges of the curved sections 50. This construction is preferred because the curved sections are continuously curved and have no edges which could damage the seismic cable. In addition, should a section 50 become worn or damaged, it can be replaced easily, without having to replace the whole reel 12.

Figure 5:
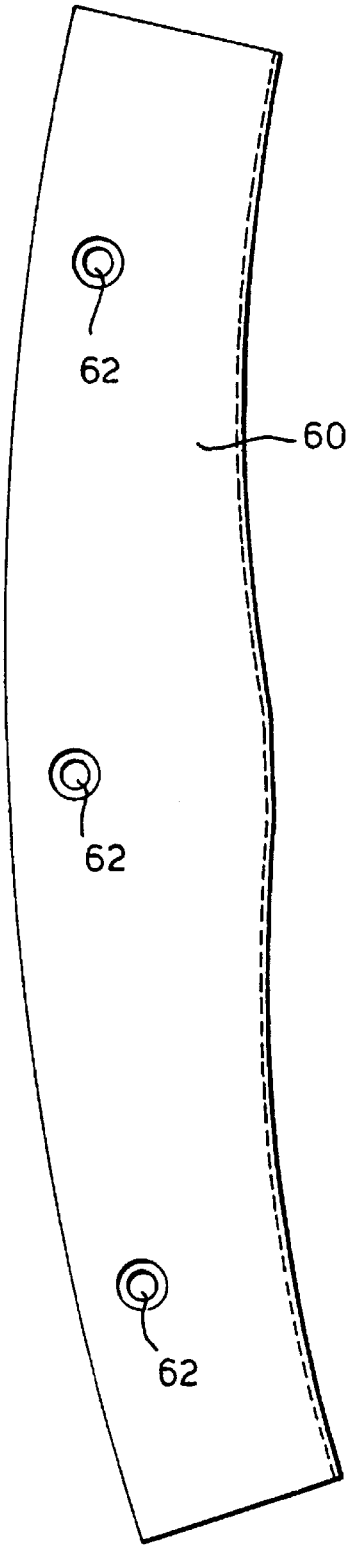
FIGS. 5 and 6 show a preferred form of construction used for the flanges of the reel assembly of the capstan winch of FIGS. 1 to 4.
Figure 6:
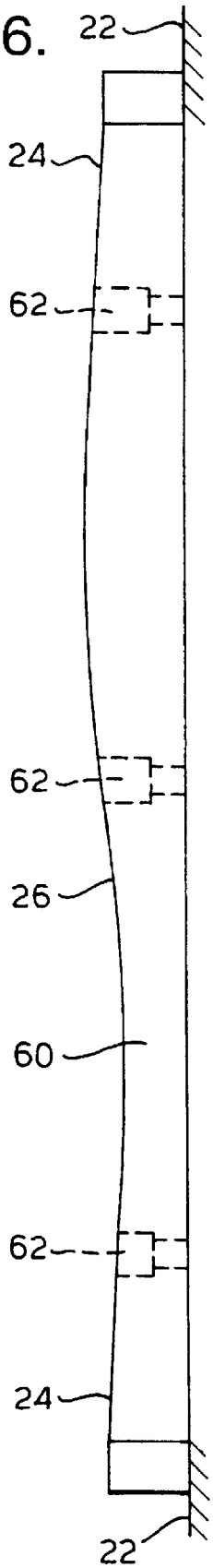

Similarly, the angled faces 24 and 26 of the floating flanges 20 are formed by a plurality of individual smoothly curved elements 60 of the kind shown in FIGS. 5 and 6. These curved elements 60 are detachable secured around the annular surface 22 of the flanges 20 by recessed screws 62, and each of them forms one whole angled face 24 and half of each of its adjacent faces 26. It will be appreciated that the curved elements 60 for one flange 20 are mirror images of the curved elements 60 of the other flange 20. Again, this form of construction is preferred because the smooth curvature of the elements 60 avoids edges which could damage the cable, and because damaged elements 60 can easily be individually replaced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reel assembly adapted for use in a capstan winch, the reel assembly comprising:

a reel mounted for rotation and having a generally cylindrical surface onto which a cable can be wound;

a pair of generally annular floating flange elements mounted for rotation with the reel, the flange elements being supported such that a pair of planes in which said flange elements rotate converge towards one another, the generally cylindrical surface of said reel being provided with a plurality of alternating lands and grooves extending from one flange element to the other flange element, the flange elements each having formed on a generally annular surface thereof a plurality of alternating inclined faces which correspond, respectively, with the plurality of alternating lands and grooves on the generally cylindrical surface of the reel, the plurality of alternating inclined faces of the flange elements contacting a cable when said cable is wound onto the reel, the plurality of alternating inclined faces of the flange elements being angled such that, the inclined faces formed on the flange elements which correspond to each land formed on the reel are generally parallel to one another, and the inclined faces formed on the flange elements which correspond to each groove formed on the reel converge towards one another, whereby substantial lateral forces are exerted on a cable being wound onto the reel only when the cable overlies the grooves formed on the reel.

2. The reel assembly of claim 1, wherein the flange elements converge towards each other symmetrically with respect to a plane approximately perpendicular to an axis of rotation of the reel.

3. The reel assembly of claim 2, wherein said plurality of inclined faces on each of the flange elements comprise:

a plurality of smoothly curved elements detachably secured around the annular face of each flange element.

4. The reel assembly of claim 2, wherein said plurality of lands and grooves on the generally cylindrical surface of said reel comprise:

a plurality of curved sections detachably secured around the cylindrical surface of the reel.

5. A capstan winch, comprising:

a reel assembly, said reel assembly including, a reel mounted for rotation and having a generally cylindrical surface onto which a cable can be wound;

a pair of generally annular floating flange elements mounted for rotation with the reel, the flange elements being supported such that a pair of planes in which said flange elements rotate converge towards one another, the generally cylindrical surface of said reel being provided with a plurality of alternating lands and grooves extending from one flange element to the other flange element, the flange elements each having formed on a generally annular surface thereof a plurality of alternating inclined faces which correspond, respectively, with the plurality of alternating lands and grooves on the generally cylindrical surface of the reel, the plurality of alternating inclined faces of the flange elements contacting a cable when said cable is wound onto the reel, the plurality of alternating inclined faces of the flange elements being angled such that, the inclined faces formed on the flange elements which correspond to each land formed on the reel are generally parallel to one another, and the inclined faces formed on the flange elements which correspond to each groove formed on the reel converge towards one another, whereby substantial lateral forces are exerted on a cable being wound onto the reel only when the cable overlies the grooves formed on the reel.

6. The capstan winch of claim 5, wherein the flange elements converge towards each other symmetrically with respect to a plane approximately perpendicular to an axis of rotation of the reel.

7. The capstan winch of claim 6, wherein said plurality of inclined faces on each of the flange elements comprise:

a plurality of smoothly curved elements detachably secured around the annular face of each flange element.

8. The capstan winch of claim 7, wherein said plurality of lands and grooves on the generally cylindrical surface of said reel comprise:

a plurality of curved sections detachably secured around the cylindrical surface of the reel.

9. The capstan winch of claim 8, further comprising:

inlet/outlet guides for guiding the cable into and out of a space between said flange elements.

* * * * *